US005810625A

United States Patent [19]

Klein et al.

[11] Patent Number: 5,810,625

[45] Date of Patent: Sep. 22, 1998

[54] ELECTRONIC DEVICE, IN PARTICULAR IN AUTOMATIC-CONTROL DEVICE

[75] Inventors: Klaus Klein, Rheinstetten; Franz Mittnacht, Karlsruhe, both of Germany

[73] Assignee: Siemens Aktiengesellschaft, Munich, Germany

[21] Appl. No.: 793,778

[22] PCT Filed: Sep. 7, 1995

[86] PCT No.: PCT/DE95/01224

§ 371 Date: May 29, 1997

§ 102(e) Date: May 29, 1997

[87] PCT Pub. No.: WO96/08853

PCT Pub. Date: Mar. 21, 1996

[30] Foreign Application Priority Data

Sep. 16, 1994 [DE] Germany ..... 9415076 U

[51] Int. Cl.[6] ..... H01R 9/22

[52] U.S. Cl. ..... 439/709; 439/835; 439/441

[58] Field of Search ..... 439/709, 835, 439/441

[56] References Cited

U.S. PATENT DOCUMENTS

| | | | |
|---|---|---|---|
| 4,576,429 | 3/1986 | Hardouin et al. | 339/95 |
| 4,768,981 | 9/1988 | Hohorst | 439/835 |
| 5,449,300 | 9/1995 | Yoon | 439/441 |
| 5,679,021 | 10/1997 | Kramer | 439/835 |
| 5,685,735 | 11/1997 | Hohorst | 439/441 |

FOREIGN PATENT DOCUMENTS

| | | |
|---|---|---|
| 0 106 768 | 4/1984 | European Pat. Off. . |
| 27 06 482 | 8/1978 | Germany . |
| 95 15 982.6 | 4/1983 | Germany . |
| 1 603 297 | 11/1981 | United Kingdom . |

OTHER PUBLICATIONS

Hess, Dirk, "*Handbuch des 19—Aufbausystems*", Markt & Technik Verlag, No. 286 (1986), pp. 286–293.

*Primary Examiner*—Gary F. Paumen
*Attorney, Agent, or Firm*—Kenyon & Kenyon

[57] ABSTRACT

An electronic device, in particular an automatic-control device, includes a basic unit and at least one connector unit designed to be plugged on to the basic unit in order to connect external leads to the device. The connector unit has at least one spring clip in a housing having apertures through which a suitable tool can be inserted in a first direction to open the clips when the connector unit is plugged in and through which external leads can be inserted in the same direction into the clips. The housing has second apertures through which a suitable tool can be inserted in a second direction to open the clips. The second apertures may be designed so that the clips can be held open by a special tool and it is possible to mount the connector unit with both hands.

6 Claims, 1 Drawing Sheet

ELECTRONIC DEVICE, IN PARTICULAR IN AUTOMATIC-CONTROL DEVICE

FIELD OF THE INVENTION

The present invention relates to an electronic device, and in particular to an automatic control device.

BACKGROUND INFORMATION

A conventional electronic device is described in a publication "Handbuch des 19"-Aufbausystem" (Handbook of the 19" Modular System) by Dr. Dirk Hesse, Markt & Technik Verlag, pages 286 to 293. The electronic device of this publication includes a basic unit and a connector unit for connecting external leads, which is structured as a multiple contact strip there. The basic unit is made up of electronic modules which are arranged in module carriers. The multiple contact strip has a housing, in which spring clips are mounted. These spring clips are electrically connected with springs of the multiple contact strip which lie on the outside of the housing and which correspond to an electronic module of the basic unit, using a bus bar. Apertures through which a suitable tool, for example a screwdriver, can be inserted in the plugged-in state of the multiple contact strip, to open the spring clips, as well as apertures through which external leads can be inserted into the spring clip, are located next to one another on the side of the housing facing away from the springs. Before an insulated external lead is introduced, the spring clip is in the closed position. It is opened by pressing down a cage tension spring with a tool. After the external lead is introduced and the tool is removed, the conductor is pressed flat against the bus bar by a clip surface of the spring clip. Since the aperture for introduction of the tool and the aperture for the external lead are arranged next to one another, on the same side of the housing, the conventional connector unit for external leads has the disadvantage that the wiring process is time-consuming and difficult, because of the small amount of space. Likewise, since the view of the apertures for the external leads can be obscured by the tool, wiring errors can occur, such that one spring clip is mistaken for another.

SUMMARY OF THE INVENTION

The present invention relates to a task of creating an electronic device, in particular an automatic control device, which makes it possible to connect external leads in simple and error-free manner.

DETAILED DESCRIPTION OF THE INVENTION

Figure 1:
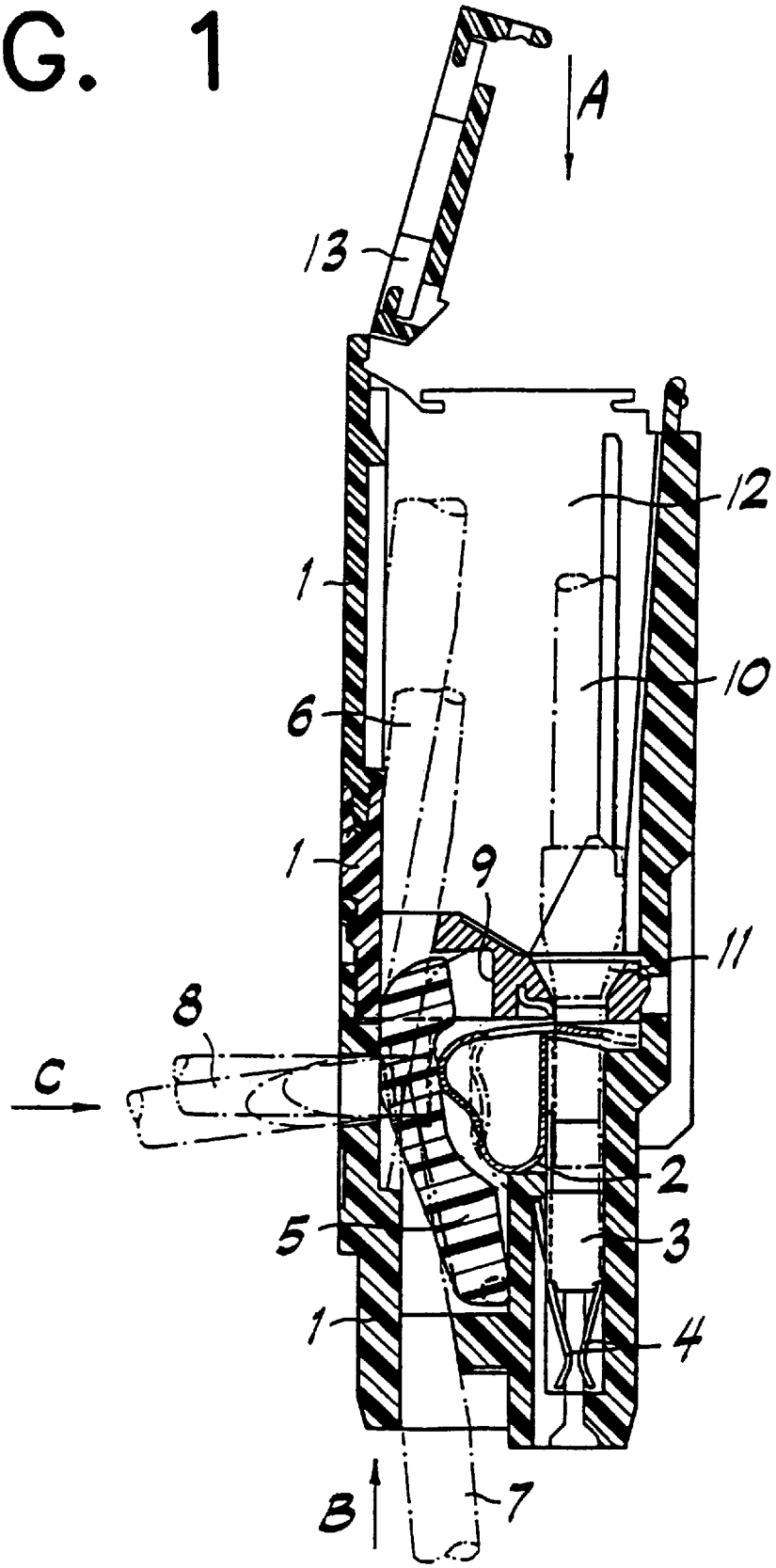
FIG. 1 shows an exemplary embodiment of a device according to the present invention.

An electronic device according to the present invention has a basic unit, not shown in the drawing, which can be composed in known manner of modules plugged into a module carrier. Furthermore, the basic unit is provided with a connector unit for connecting external leads, the cross-section of which is shown in the FIG. 1. In an automatic control device, the connector unit is needed, for example, for connecting actuators and sensors to peripheral modules. The necessary wiring work takes place at the site of use. In a housing 1 of the device, several spring clips are arranged behind one another, perpendicular to the plane of the drawing; only a spring clip 2 is shown in FIG. 1. The spring clip

2 is connected with a spring 4, which serves to contact a front plug, not shown, of a peripheral module, via a flat contact 3. A lever 5, which is rotatably mounted, rests on the back of the flexible shank of the spring clip 2. On the back of the lever 5, in turn, there is a driving surface for a tool 6, 7 or 8, for example a screwdriver, which can be inserted into the housing 1 through apertures A, B or C, glides down the back of the lever 5, and presses it down at most up to a contact surface 9. The tip of a screwdriver as the tool in the apertures, as well as the position of the rotary-mounted lever 5 and the spring clip 2 in the contact position, are shown with broken lines in FIG. 1. When the spring clip 2 is open, a wire 10, also shown with a broken line, can be inserted through an aperture 11, which is also accessible from the direction A. To hold several wires one behind the other in the device, a cable channel 12 is provided above the apertures for the various spring clips, which are arranged one behind the other perpendicular to the plane of the drawing; this channel can be closed with a door 13 after the wiring work is complete.

In the direction A, wiring work or a correction can take place both when the connector unit is plugged in, i.e. when it is plugged onto the front plug of a flat module, and when it is not connected to the basic unit. In advantageous manner, the view of the apertures for the external leads is not obscured by a tool if the latter is inserted through apertures of the directions B or C. For this purpose, it is usually necessary to remove the connector unit from the front plug of the module. To make it easier to find the apertures of a certain spring clip, the three assigned apertures of the directions A through C, in each instance, are provided with uniform labeling. To open several spring clips at the same time, a special tool, for example a comb or a toggle press, can also be used; this tool is designed in such a way that the connector unit is clamped into it, to make wiring easier. In this connection, it is advantageous if the leads are introduced with both hands, one after the other, and contacted at the same time by removing the tool. This makes the wiring process significantly simpler. In the directions A and B, the screwdriver or comb remains in position, by being clamped in place, without having to be held. This also makes it possible to install the external leads with both hands, while the spring clips are open. By opening the spring clips via plastic levers, electrical contact with the tool is avoided, and overly great mechanical stress on the spring clips is prevented. The fact that the lever 5 is mounted with a rotary joint ensures that only one force component acts on the spring clip 2 in the bending direction, and damage caused by the tool is also prevented.

What is claimed is:

1. A connector unit for connecting external leads to an electronic device, comprising:

a housing including at least one spring clip and a first aperture adapted for inserting therethrough a suitable tool in a first direction to open the at least one spring clip and for allowing external leads to be inserted therethrough in the first direction to couple with the at least one spring clip, the housing further including second and third apertures adapted for inserting the suitable tool therethrough in one of a second and a third direction to open the at least one spring clip, wherein the second direction is substantially opposite to the first direction and wherein the third direction is substantially perpendicular to the second direction.

2. The connector unit according to claim 1, further comprising:

a limiting device for limiting an extension of the at least one spring clip for protecting the at least one spring clip from stress.

3. The connector unit according to claim 2, wherein the limiting device includes a stop member and a lever rotatably mounted in the housing, the lever resting against the stop member, the suitable tool acting on the stop member to resist a return force of the at least one spring clip.

4. The connector unit according to claim 1, wherein the apertures are labeled to correspond to a respective one of the at least one spring clip.

5. An electronic device, comprising:

an circuit unit; and at least one coupling unit for connecting external leads to the circuit unit, the at least one coupling unit including a housing, the housing including at least one spring clip and a first aperture adapted for inserting therethrough a suitable tool in a first direction to open the at least one spring clip and for allowing external leads to be inserted therethrough in the first direction to couple with the at least one spring clip, the housing further including second and third apertures adapted for inserting the suitable tool therethrough in one of a second and a third direction to open the at least one spring clip, wherein the second direction is substantially opposite to the first direction and wherein the third direction is substantially perpendicular to the second direction.

6. The electronic device according to claim 5, wherein the electronic device is an automatic control device.

* * * * *